US008667705B2

(12) United States Patent
Shin et al.

(10) Patent No.: US 8,667,705 B2
(45) Date of Patent: Mar. 11, 2014

(54) CLOTHES DRYER AND LINT CLEANING DEVICE THEREOF

(75) Inventors: Chang Bong Shin, Suwon-si (KR); Sung Jin Park, Seoul (KR); Jin Wook Yoon, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 222 days.

(21) Appl. No.: 13/137,833

(22) Filed: Sep. 15, 2011

(65) Prior Publication Data

US 2012/0084992 A1 Apr. 12, 2012

(30) Foreign Application Priority Data

Oct. 12, 2010 (KR) ..... 10-2010-0099072

(51) Int. Cl.
*F26B 21/06* (2006.01)

(52) U.S. Cl.
USPC ..... 34/82; 34/595; 34/601; 68/18 R; 68/20; 8/137

(58) Field of Classification Search
USPC ..... 34/82, 595, 601, 606, 610; 68/5 C, 18 R, 68/20; 8/137, 149, 159
See application file for complete search history.

(56) References Cited

U.S. PATENT DOCUMENTS

| | | | | |
|---|---|---|---|---|
| 4,462,170 | A | 7/1984 | Burkall et al. | |
| 4,700,492 | A | 10/1987 | Werner et al. | |
| 7,305,775 | B2 * | 12/2007 | Favret et al. | 34/82 |
| 7,805,856 | B2 * | 10/2010 | Gaβmann et al. | 34/85 |
| 7,913,415 | B2 * | 3/2011 | Goldberg et al. | 34/82 |
| 2006/0201014 | A1 * | 9/2006 | Favret et al. | 34/82 |
| 2010/0154240 | A1 * | 6/2010 | Grunert | 34/82 |
| 2011/0167661 | A1 * | 7/2011 | Goldberg et al. | 34/82 |
| 2012/0084992 | A1 * | 4/2012 | Shin et al. | 34/82 |
| 2012/0144694 | A1 * | 6/2012 | Ricklefs et al. | 34/546 |
| 2013/0145577 | A1 * | 6/2013 | Davidshofer et al. | 15/383 |

FOREIGN PATENT DOCUMENTS

| | | | |
|---|---|---|---|
| DE | 4427771 | | 2/1996 |
| EP | 1947232 | A1 * | 7/2008 |
| EP | 2055825 | A1 * | 5/2009 |
| EP | 2145999 | A1 * | 1/2010 |
| EP | 2146000 | | 1/2010 |
| EP | 2189568 | A1 * | 5/2010 |
| FR | 2931487 | A1 * | 11/2009 |
| JP | 2006271829 | * | 10/2006 |
| WO | WO 9508016 | A1 * | 3/1995 |

OTHER PUBLICATIONS

Extended European Search Report dated Apr. 27, 2012 issued in corresponding European Patent Application No. 11182284.7.

* cited by examiner

*Primary Examiner* — Steve M Gravini
(74) *Attorney, Agent, or Firm* — Staas & Halsey LLP

(57) ABSTRACT

A clothes dryer having a lint cleaning device to collect and store lint generated during drying through a simple structure. The lint cleaning device, including a filter, a rectilinear blade performing a rectilinear motion to collect lint, and a rotary blade performing a rotary motion interlocking with the rectilinear motion of the rectilinear blade to collect lint, collects lint at a spot and stores the collected lint in a compressed state. The lint cleaning device is used for a long time without replacement.

20 Claims, 19 Drawing Sheets

41

CLOTHES DRYER AND LINT CLEANING DEVICE THEREOF

CROSS-REFERENCE TO RELATED APPLICATIONS

This application claims the benefit of Korean Patent Application No. 2010-0099072, filed on Oct. 12, 2010 in the Korean Intellectual Property Office, the disclosure of which is incorporated herein by reference.

BACKGROUND

1. Field

Embodiments of the present disclosure relate to a clothes dryer having a cleaning device to clean lint generated during drying of clothes.

2. Description of the Related Art

A clothes dryer dries laundry using high-temperature dry air. During drying of the laundry, lint (nap and fluff) is generated. When such lint is attached to a blowing fan, components of the clothes dryer may be damaged. For this reason, the clothes dryer may be provided with a filter to filter lint.

When the lint accumulates on the filter, the flow of air is disturbed with the result that the performance of the clothes dryer may be lowered. For this reason, the lint may be periodically removed from the filter.

A cleaning device to automatically perform serious operations, such as filtering lint using a filter and collection, conveyance and storage of the lint attached to the filter, may be provided in the clothes dryer so as to maintain the performance of the clothes dryer.

SUMMARY

It is an aspect of the present disclosure to provide a clothes dryer having a lint cleaning device to collect and store lint attached to a filter through a simple structure.

It is another aspect of the present disclosure to provide a lint cleaning device to store the collected lint in a compressed state wherein the lint cleaning device is used for a long time without replacement.

Additional aspects of the disclosure will be set forth in part in the description which follows and, in part, will be apparent from the description, or may be learned by practice of the disclosure.

In accordance with one aspect of the present disclosure, a clothes dryer includes a case forming the external appearance thereof, a drum rotatably mounted in the case, an intake duct to guide external air so that the air is supplied to the drum, an exhaust duct to guide air in the drum so that the air is discharged to the outside, a blower mounted in the exhaust duct, and a collection unit mounted between the drum and the blower, the collection unit including a filter to filter lint, a rectilinear blade configured to be rectilinearly moved by a drive source to collect the lint, and a rotary blade configured to perform a rotary motion interlocking with the rectilinear motion to collect the lint.

The clothes dryer may further include a storage unit including a tank to store the lint collected by the rectilinear blade and the rotary blade and a push plate mounted in the tank so that the push plate moves inward and outward to open and close an inlet of the tank and, at the same time, to compress the lint.

The collection unit may have a discharge port formed at a space where the lint is collected by the rectilinear blade and the rotary blade, and the discharge port of the collection unit may communicate with the inlet of the tank of the storage unit.

The push plate of the storage unit may open the inlet of the tank of the storage unit when the rectilinear blade and the rotary blade of the collection unit collect the lint and discharge the collected lint through the discharge port of the collection unit.

The clothes dryer may further include at least one drive motor to drive the collection unit and the storage unit.

The collection unit may further include an introduction port communicating with the drum, and the introduction port may include a screen to prevent articles to be dried from being introduced into the collection unit.

The collection unit may further include a guide bar to guide the motion of the rectilinear blade.

The drive source may include a motor and a spiral configured to be rotated by drive force from the motor.

The rectilinear blade may include an insertion end positioned in a valley of the spiral, and the insertion end may perform a rectilinear motion interlocking with the rotary motion of the spiral so that the rectilinear blade performs the rectilinear motion.

The rectilinear blade may include a catching protrusion, and the rotary blade may include a catching groove, in which the catching protrusion is positioned so as to move inward and outward, formed in a longitudinal direction thereof.

The rotary blade may be hingedly coupled in the collection unit so that the catching protrusion moves inward into and outward from the catching groove to rotate the rotary blade.

The push plate may include an upper end surface to which a button having a round surface is hingedly coupled so that the button is rotated upward and downward, an opening and closing surface to open and close the inlet, and a compression surface to compress lint.

The push plate may include a first elastic member and a second elastic member, the first elastic member may elastically bias the opening and closing surface and the compression surface so that the opening and closing surface closes the inlet and, at the same time, the compression surface compresses lint, and the second elastic member may elastically bias the button so that the round surface of the button protrudes above the upper end surface of the push plate.

The storage unit may include a push rod to push the button in a direction in which the opening and closing surface opens the inlet.

The storage unit may further include a switch to push the button so that the button is hidden below the upper end surface of the push plate.

The storage unit may be detachably coupled to the collection unit.

The tank may include hooked ribs formed therein at predetermined intervals to prevent swelling of the compressed lint.

In accordance with another aspect of the present disclosure, a clothes dryer includes a case forming the external appearance thereof, a drum rotatably mounted in the case, an intake duct to guide external air so that the air is supplied to the drum, an exhaust duct to guide air in the drum so that the air is discharged to the outside, a blower mounted in the exhaust duct, and a cleaning device mounted between the drum and the blower to clean lint, wherein the cleaning device includes a collection unit to filter and collect lint and a storage unit to compress and store the lint; the collection unit includes a filter to filter lint, a rectilinear blade configured to be rectilinearly moved by a drive source to collect the lint, and a rotary blade configured to perform a rotary motion interlocking with the rectilinear motion to collect the lint, and the storage unit includes a tank to store the lint and a push plate mounted in the tank so that the push plate moves inward and outward to open and close an inlet of the tank and, at the same time, to compress the lint.

In accordance with another aspect of the present disclosure, a lint cleaning device, mounted between a drum and a blower of a clothes dryer, includes a filter to filter lint, a rectilinear blade configured to be rectilinearly moved by a drive source to collect the lint, and a rotary blade configured to perform a rotary motion interlocking with the rectilinear motion to collect the lint.

In accordance with a further aspect of the present disclosure, a lint cleaning device, mounted between a drum and a blower of a clothes dryer, includes a collection unit to filter and collect lint and a storage unit to compress and store the lint, wherein the collection unit includes a filter to filter lint, a rectilinear blade configured to be rectilinearly moved by a drive source to collect the lint, and a rotary blade configured to perform a rotary motion interlocking with the rectilinear motion to collect the lint, and the storage unit includes a tank to store the lint and a push plate mounted in the tank so that the push plate moves inward and outward to open and close an inlet of the tank and, at the same time, to compress the lint.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
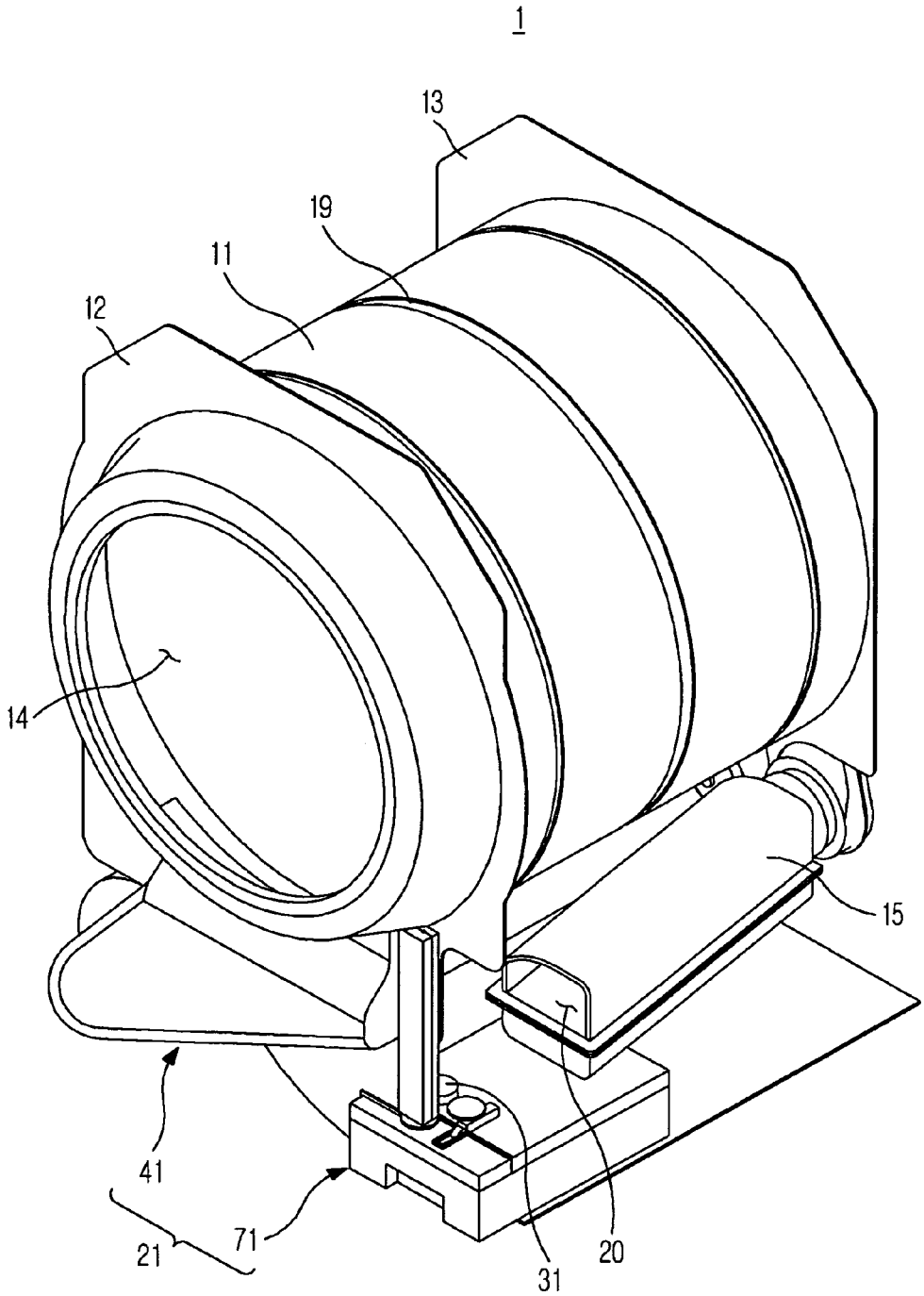
FIG. 1 is a perspective view illustrating the external appearance of a clothes dryer according to an embodiment of the present disclosure.

Reference will now be made in detail to the embodiments of the present disclosure, examples of which are illustrated in the accompanying drawings, wherein like reference numerals refer to like elements throughout.

Figure 2:
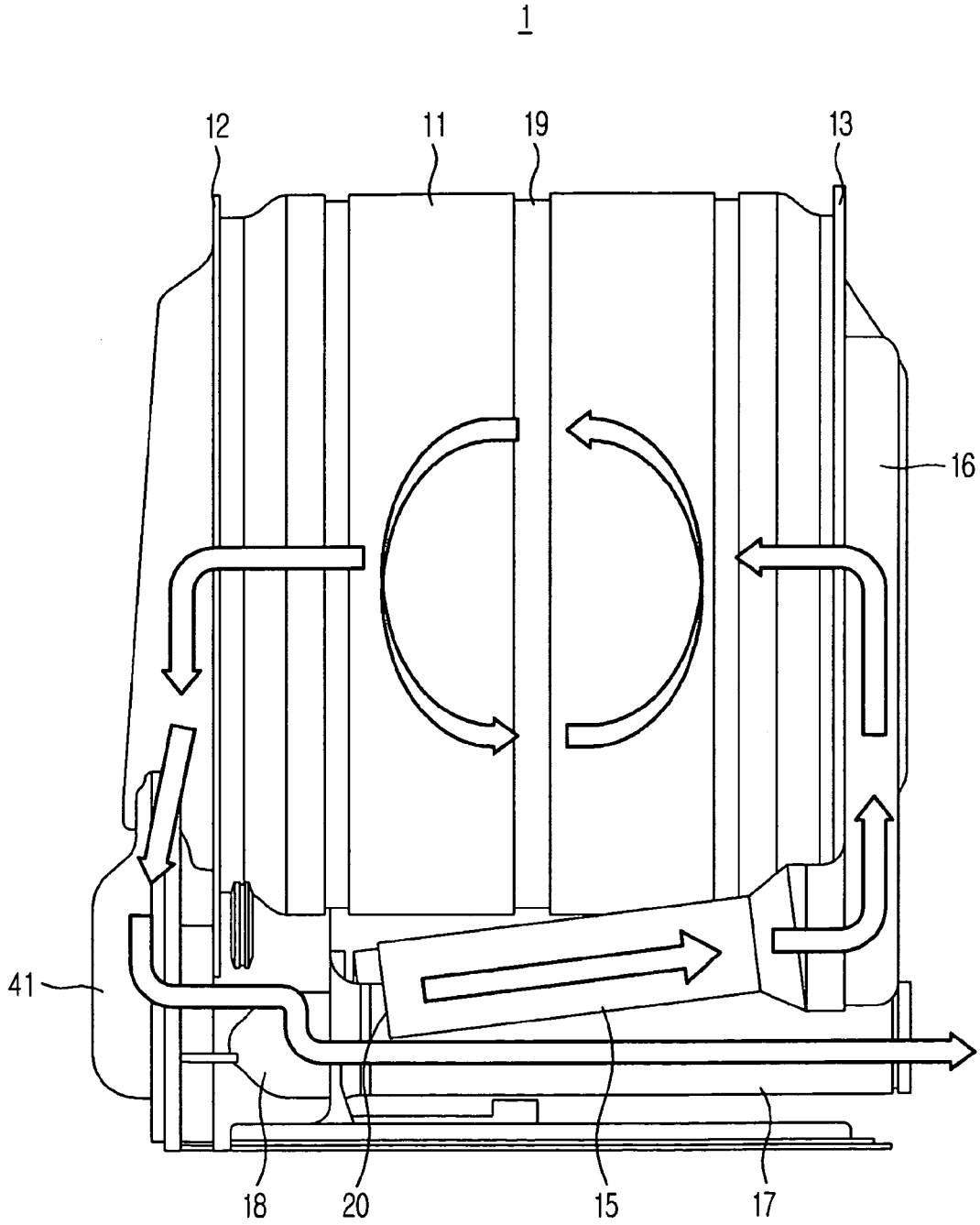
FIG. 2 is a side sectional view illustrating the flow of air in the clothes dryer according to the embodiment of the present disclosure.

FIG. 1 is a perspective view illustrating the external appearance of a clothes dryer according to an embodiment of the present disclosure, and FIG. 2 is a side sectional view illustrating the flow of air in the clothes dryer according to the embodiment of the present disclosure.

A clothes dryer 1 includes a case (not shown), a heater 15, an intake duct 16, a drum 11, a lint cleaning device 21, a blower 18 and an exhaust duct 17.

The case (not shown) forms the external appearance of the clothes dryer 1. The drum 11 is mounted in the case (not shown).

The drum 11 is provided at the front thereof with an inlet port 14 through which clothes to be dried are introduced. The drum 11 is rotatably mounted to the case (not shown) via a front support member 12 and a rear support member 13.

The heater 15 heats air introduced through a heat intake port 20 into high-temperature dried air. The heater 15 and the drum 11 communicate with the intake duct 16.

After drying, humid air is discharged to the outside of the drum 11 through the exhaust duct 17. The blower 18 to create such flow of air is mounted in the exhaust duct 17. Although not shown, a motor (not shown) to drive the drum 11 and the blower 18 is provided. Generally, rotary force from the motor (not shown) is transmitted to the drum 11 via a belt (not shown) connected between a pulley (not shown) configured to be rotated by the motor (not shown). Unexplained reference numeral 19 indicates a belt connection part to which the belt is connected.

In the clothes dryer according to the embodiment, the cleaning device 21 to clean lint generated during drying is mounted between the drum 11 and the blower 18.

The cleaning device 21 includes a collection unit 41 to filter and collect lint and a storage unit 71 to compress and store the collected lint. The collection unit 41 and the storage unit 71 are operated in an interlocking manner by at least one drive motor 31. Also, the storage unit 71 may be separated from the collection unit 41.

Figure 3:
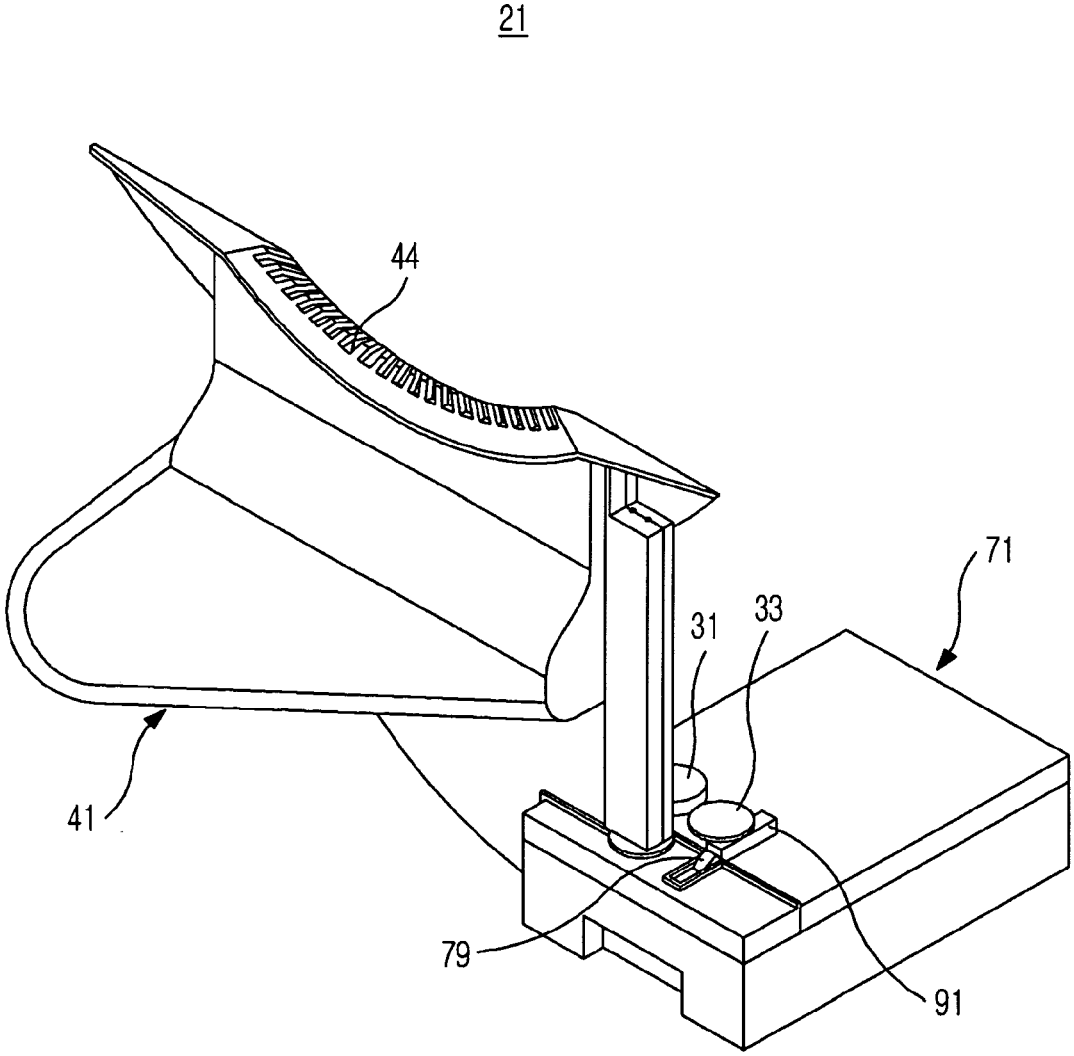
FIG. 3 is a perspective view illustrating a cleaning device of the clothes dryer according to the embodiment of the present disclosure.
Figure 4:
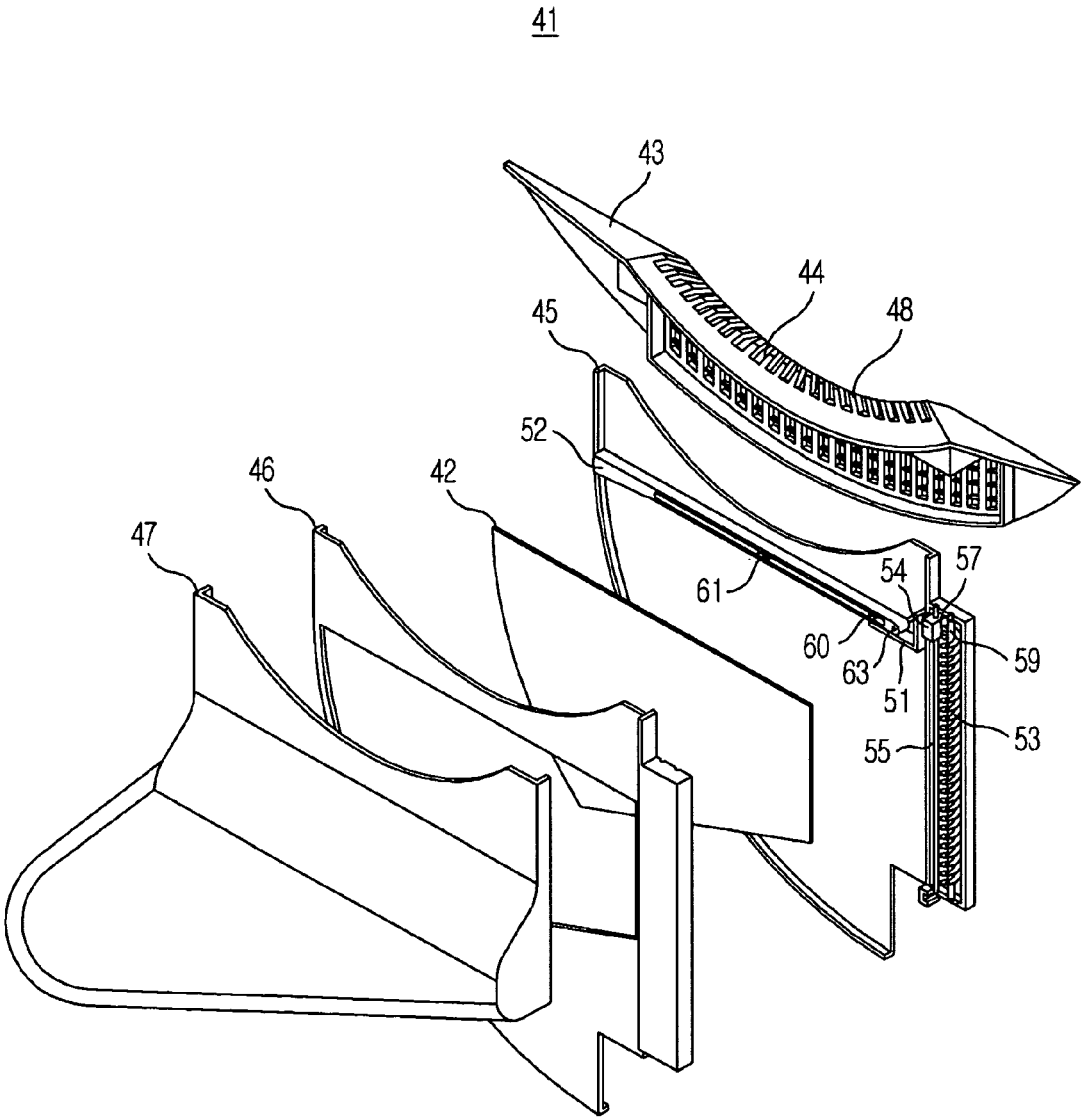
FIG. 4 is an exploded view illustrating the principal part of a collection unit of the clothes dryer according to the embodiment of the present disclosure.
Figure 5A:
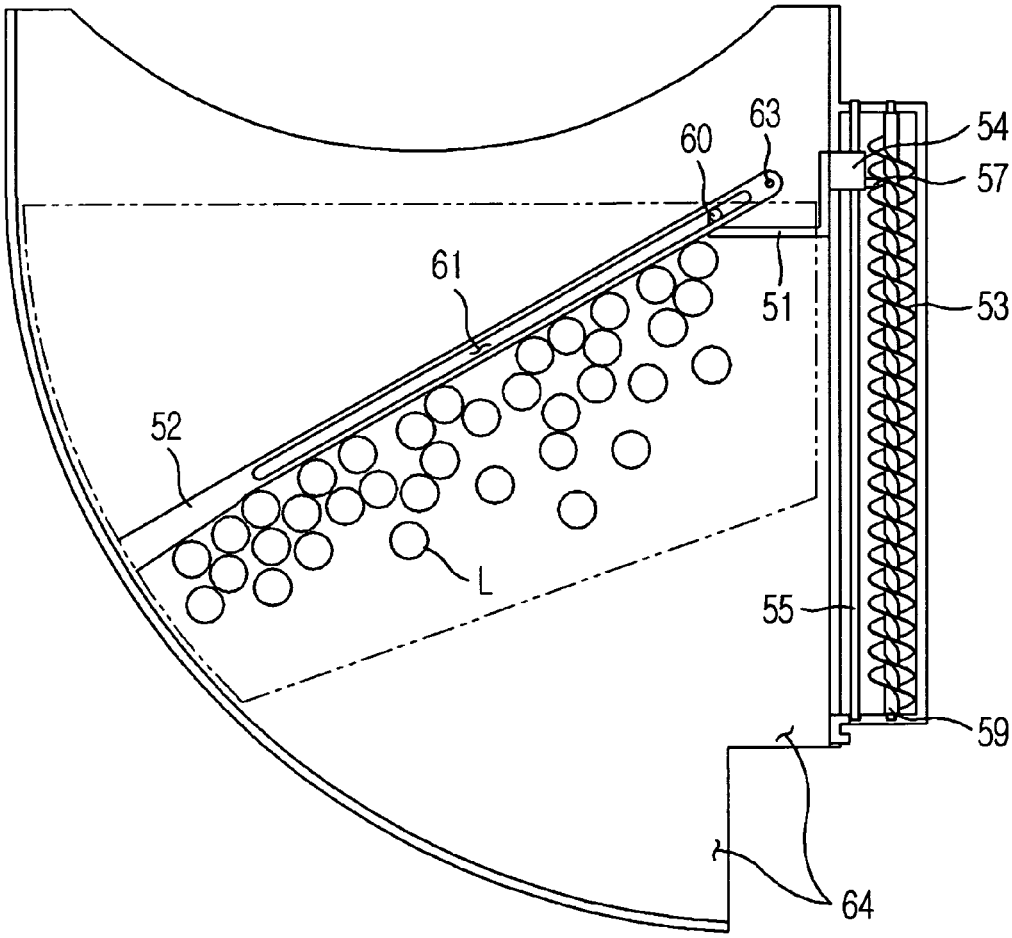
FIGS. 5A to 5C are views illustrating a series of operations of the collection unit of the clothes dryer according to the embodiment of the present disclosure.
Figure 5B:
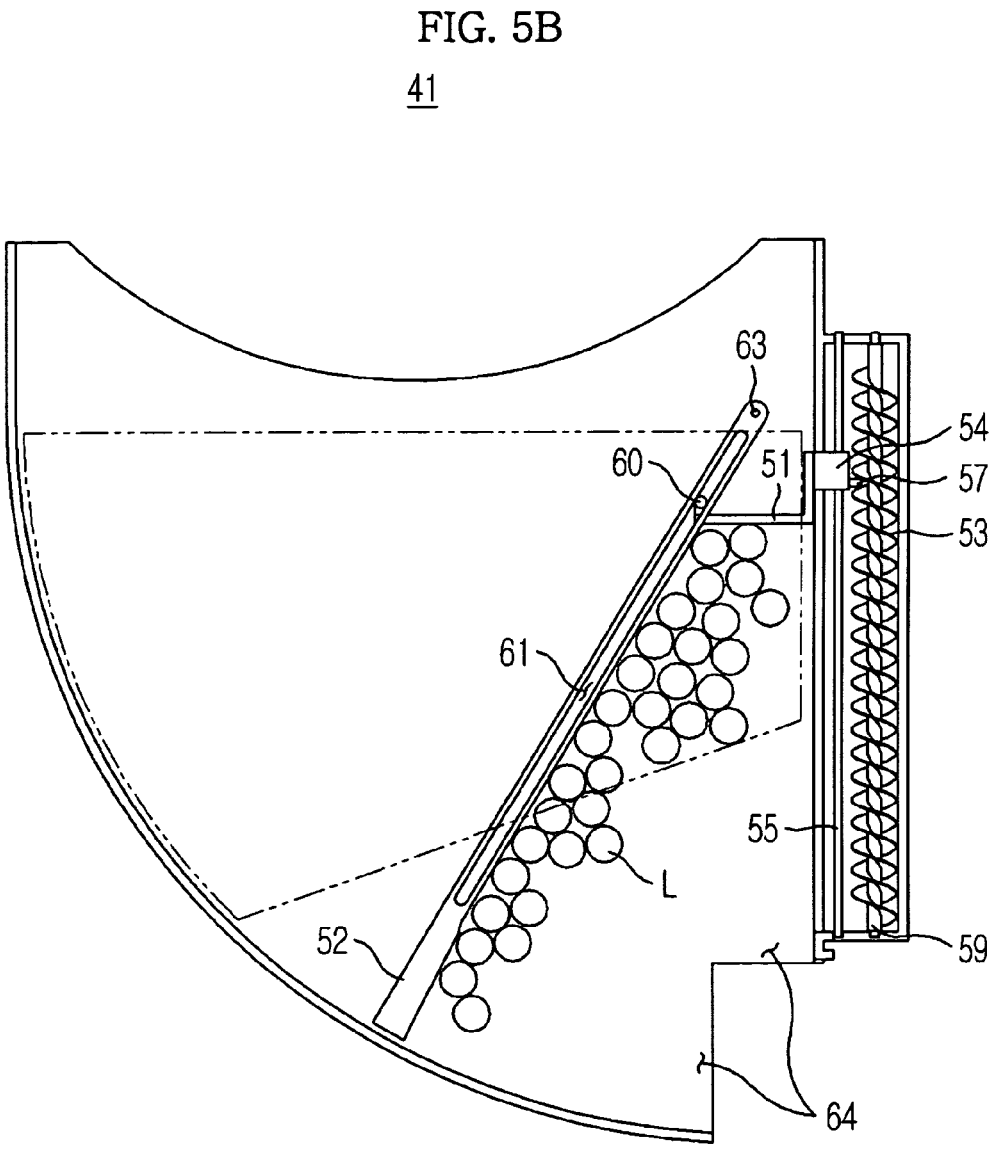
Figure 5C:
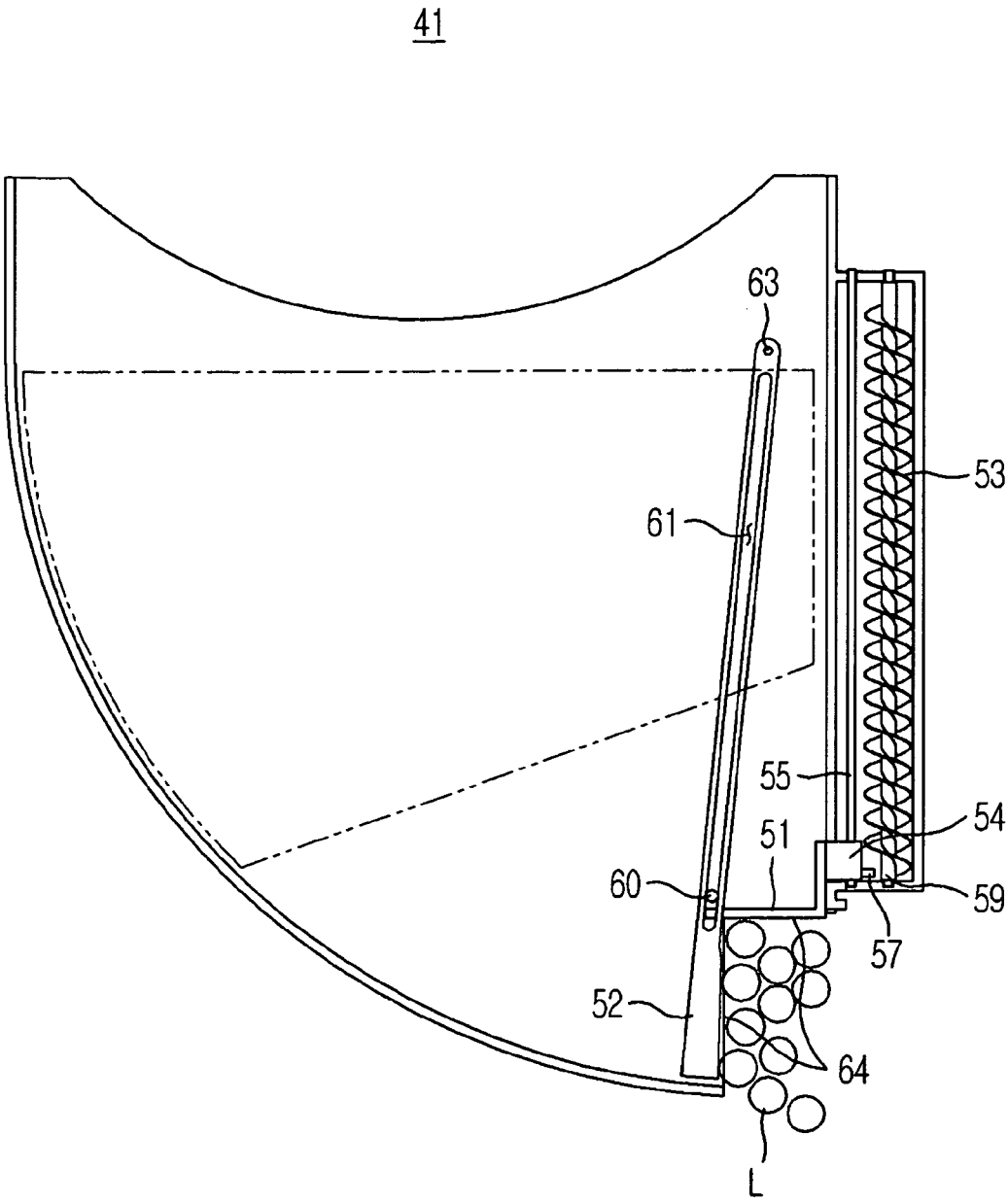

FIG. 3 is a perspective view illustrating a cleaning device of the clothes dryer according to the embodiment of the present disclosure, FIG. 4 is an exploded view illustrating the principal part of a collection unit of the clothes dryer according to the embodiment of the present disclosure, and FIGS. 5A to 5C are views illustrating a series of operations of the collection unit of the clothes dryer according to the embodiment of the present disclosure.

Hereinafter, the collection unit of the clothes dryer according to the embodiment of the present disclosure will be described in detail with reference to the above drawings.

The collection unit 41 includes a filter 42, a rectilinear blade 51 and a rotary blade 52.

As shown in FIG. 4, the filter 42 is disposed between a collection unit base 45 and a connection unit cover 47 in a state in which the filter 42 is fitted in a filter frame 46. The filter 42, the filter frame 46 and the collection unit base 45 are configured approximately in the shape of an arc. The collection unit cover 47 is somewhat thick so that air, from which lint is filtered while passing through the collection unit 41, is directed to the exhaust duct 17 connected to the left lower side of the collection unit cover 47. Also, the collection unit cover 47 somewhat protrudes toward the exhaust duct 17.

Above the collection unit base 45 is provided a collection unit cap 43 having an introduction port 44 through which air is introduced. In the introduction port 44 is provided a screen 48 to prevent small clothes, such as socks or handkerchiefs, from being introduced from the drum 11.

The rectilinear blade 51 and the rotary blade 52 are provided in a space between the filter and the collection unit base 45 to collect lint attached to the filter 42.

When power from a spiral 53 rotated about a rotary shaft 59 by the drive motor 31 is transmitted to the rectilinear blade 51, the rectilinear blade 51 performs a rectilinear motion over a predetermined section in the collection unit 41.

The rectilinear blade 51 includes an insertion end 57 positioned in a valley of the spiral 53. As the insertion end 57 rectilinearly moves along the valley of the spiral 53, the rectilinear blade 51 performs a rectilinear motion.

The collection unit 41 has a guide bar 55 to guide the rectilinear motion of the rectilinear blade 51 and support the rectilinear blade 51. The guide bar 55 vertically extends through the rectilinear blade 51 to guide the rectilinear motion of the rectilinear blade 51 and support the rectilinear blade 51.

The rectilinear blade 51 may have a protrusion 54 protruding toward the spiral 53 so that the rectilinear blade 51 is stably guided and supported by the guide bar 55. The guide bar 55 may be fitted on the protrusion 54, and the insertion end 57 may be provided at the protrusion 54.

Meanwhile, the rotary blade 52 has a catching protrusion 60 formed at the end of the rectilinear blade 51 opposite to the spiral 53 so that the rotary blade 52 interlocks with the rectilinear blade 51.

The rotary blade 52 is formed approximately in the shape of a long rod. In the rotary blade 52 is formed a catching groove 61 in which the catching protrusion 60 of the rectilinear blade 51 is positioned so as to move inward and outward. Also, one end of the rotary blade 52 is hingedly coupled to the collection unit base 45 so that the rotary blade 52 performs a rotary motion.

In the above structure, when the rectilinear blade 51 moves downward, the catching protrusion 60 of the rectilinear blade 51 moves to the left in the catching groove 61 of the rotary blade 52 and, at the same time, the rotary blade 52 rotates about a hinged rotation shaft 63 counterclockwise.

As shown in FIGS. 5A through 5C, the rectilinear blade 51 performs a rectilinear motion over a predetermined section, and the rotary blade 52, interlocking with the rectilinear blade 51, performs a rotary motion over a predetermined section. As a result, lint L attached to the filter 42 is collected at the right lower end of the collection unit 41.

At the right lower end of the collection unit 41 is provided a lint discharge port 64 through which the lint L, collected at the right lower end of the collection unit 41, is discharged to the outside. The collected lint L may be stored in the storage unit 71 through the lint discharge port 64.

Figure 6:
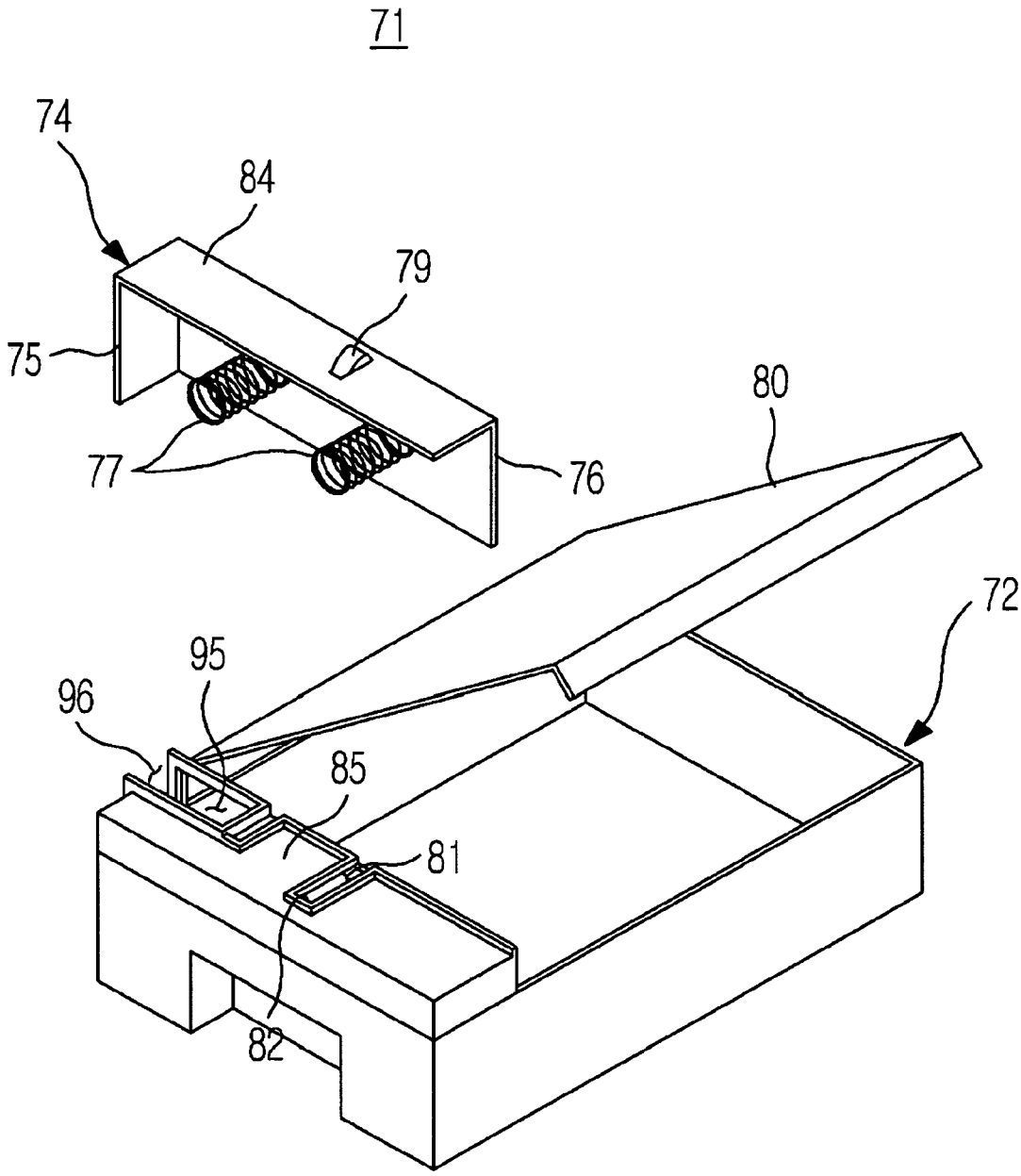
FIG. 6 is an exploded view illustrating the principal part of a storage unit of the clothes dryer according to the embodiment of the present disclosure.

FIG. 6 is an exploded view illustrating the principal part of the storage unit of the clothes dryer according to the embodiment of the present disclosure, FIGS. 7A to 7D are perspective views illustrating a series of operations of the storage unit of the clothes dryer according to the embodiment of the present disclosure, and FIGS. 8A to 8D are side sectional views illustrating a series of operations of the storage unit of the clothes dryer according to the embodiment of the present disclosure.

Figure 7A:
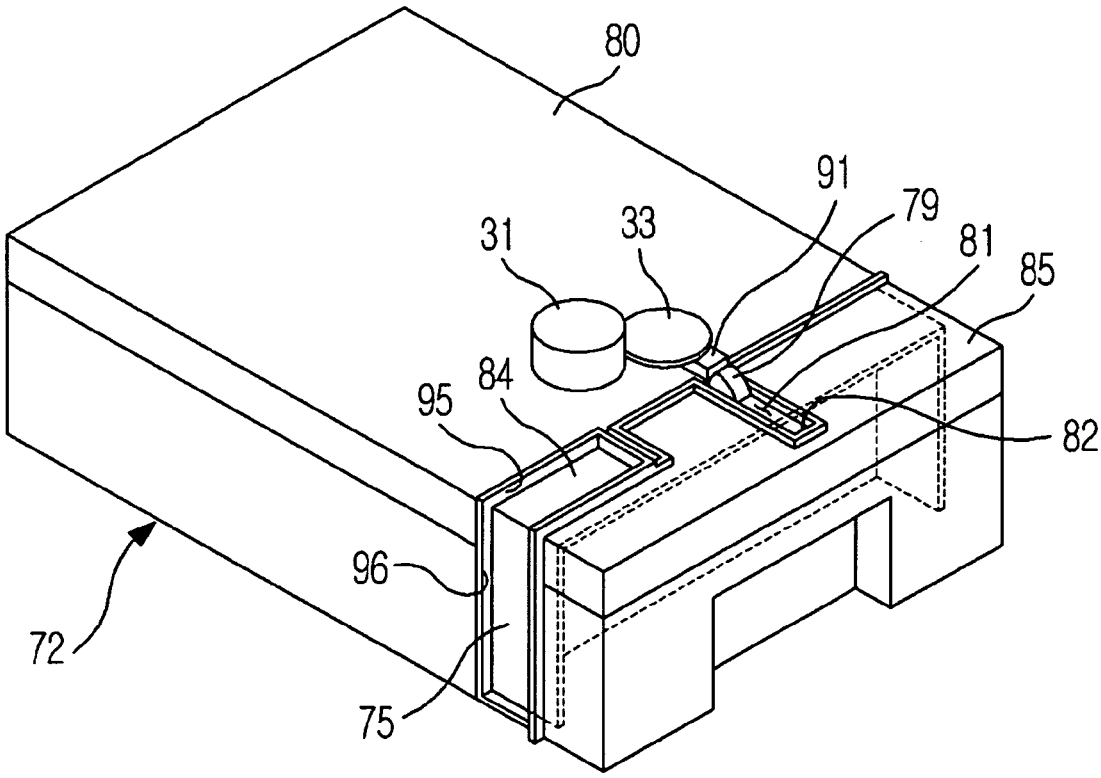
FIGS. 7A to 7D are perspective views illustrating a series of operations of the storage unit of the clothes dryer according to the embodiment of the present disclosure.
Figure 7B:
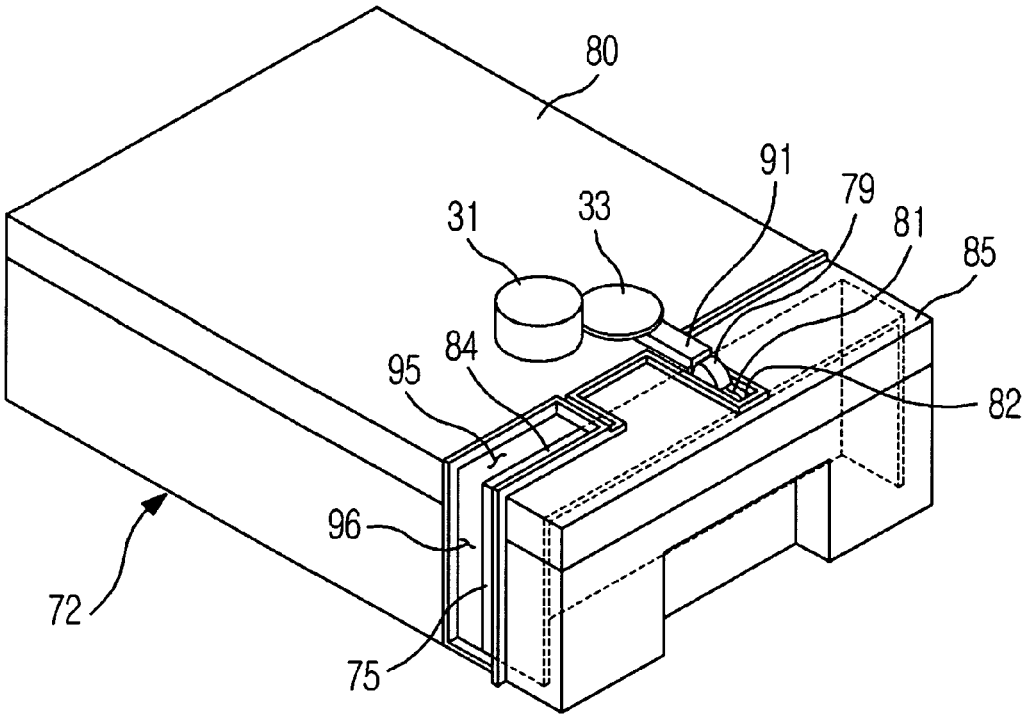
Figure 7C:
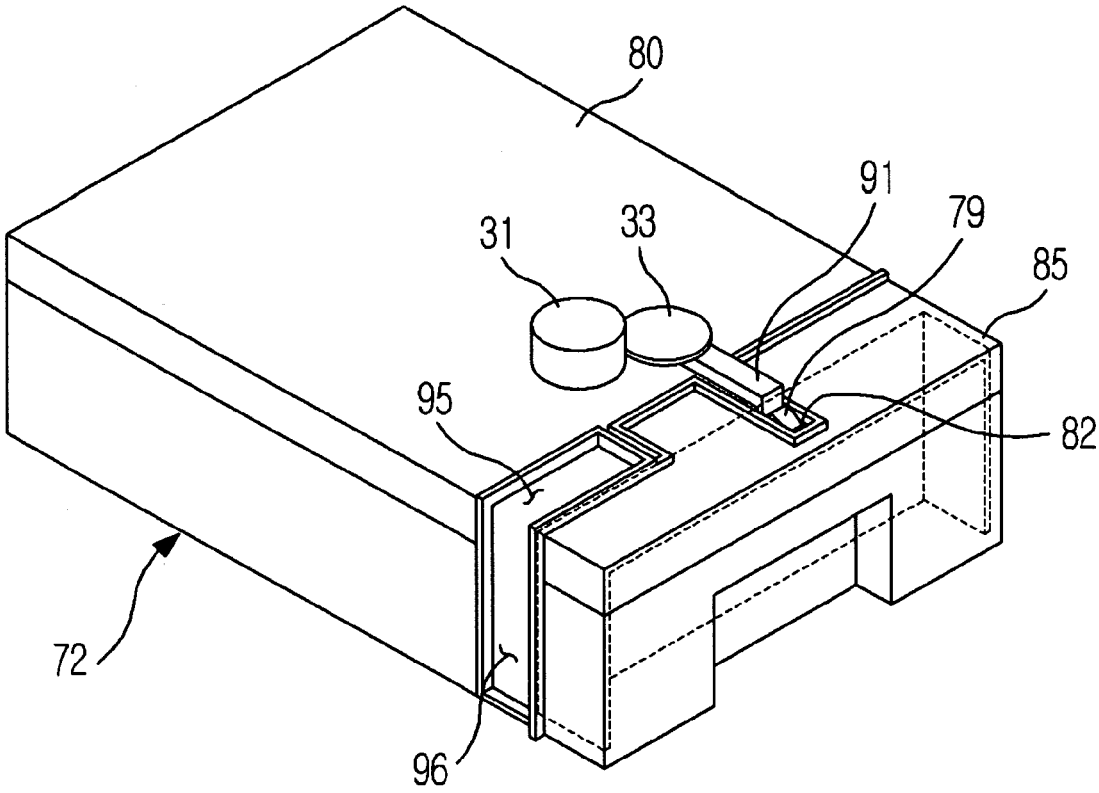
Figure 7D:
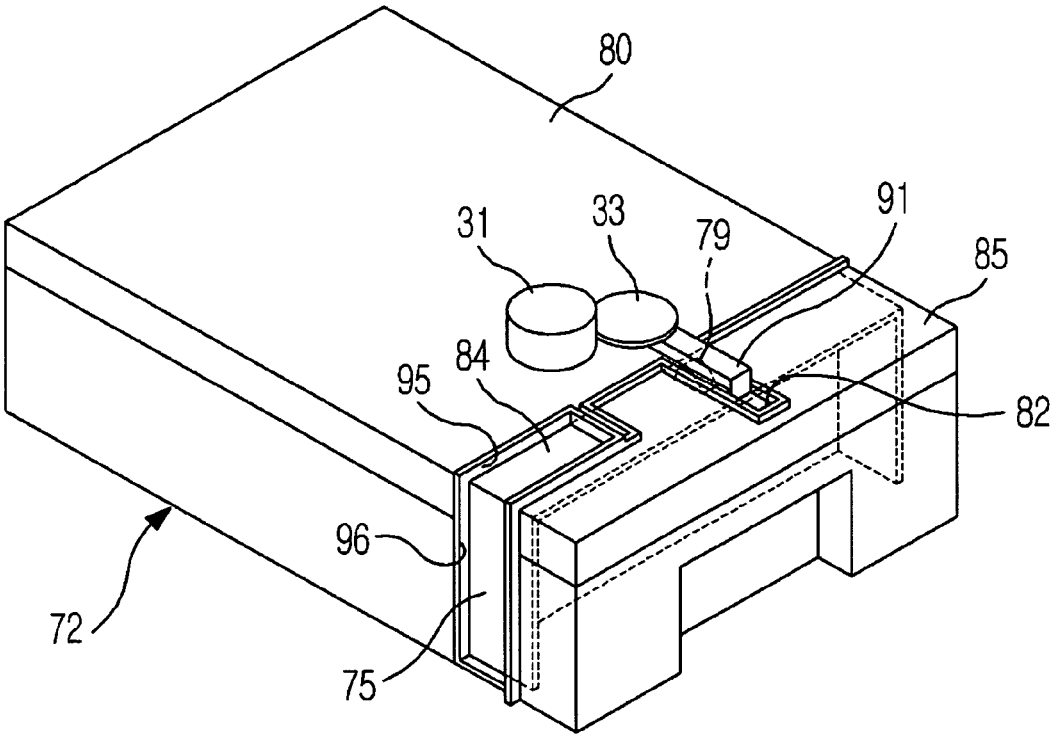
Figure 8A:
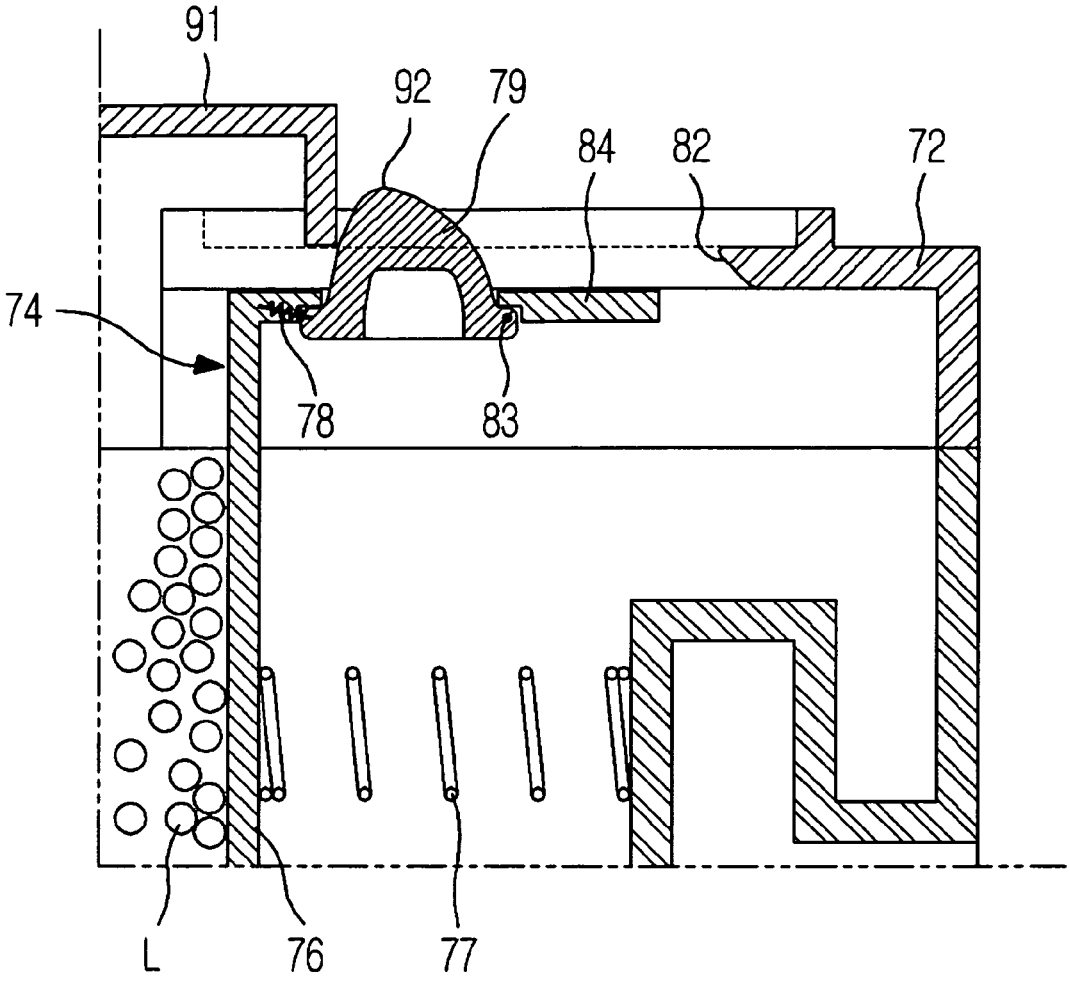
FIGS. 8A to 8D are side sectional views illustrating a series of operations of the storage unit of the clothes dryer according to the embodiment of the present disclosure.
Figure 8B:
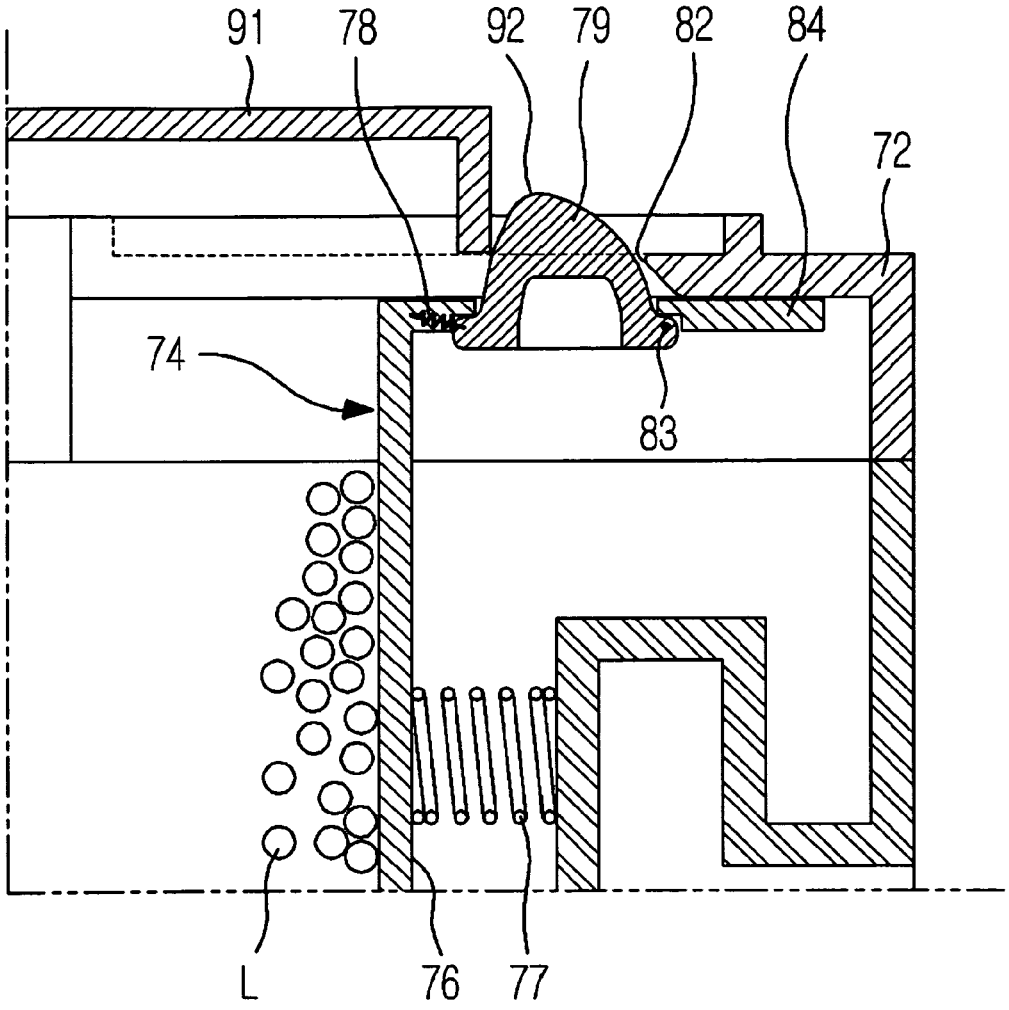
Figure 8C:
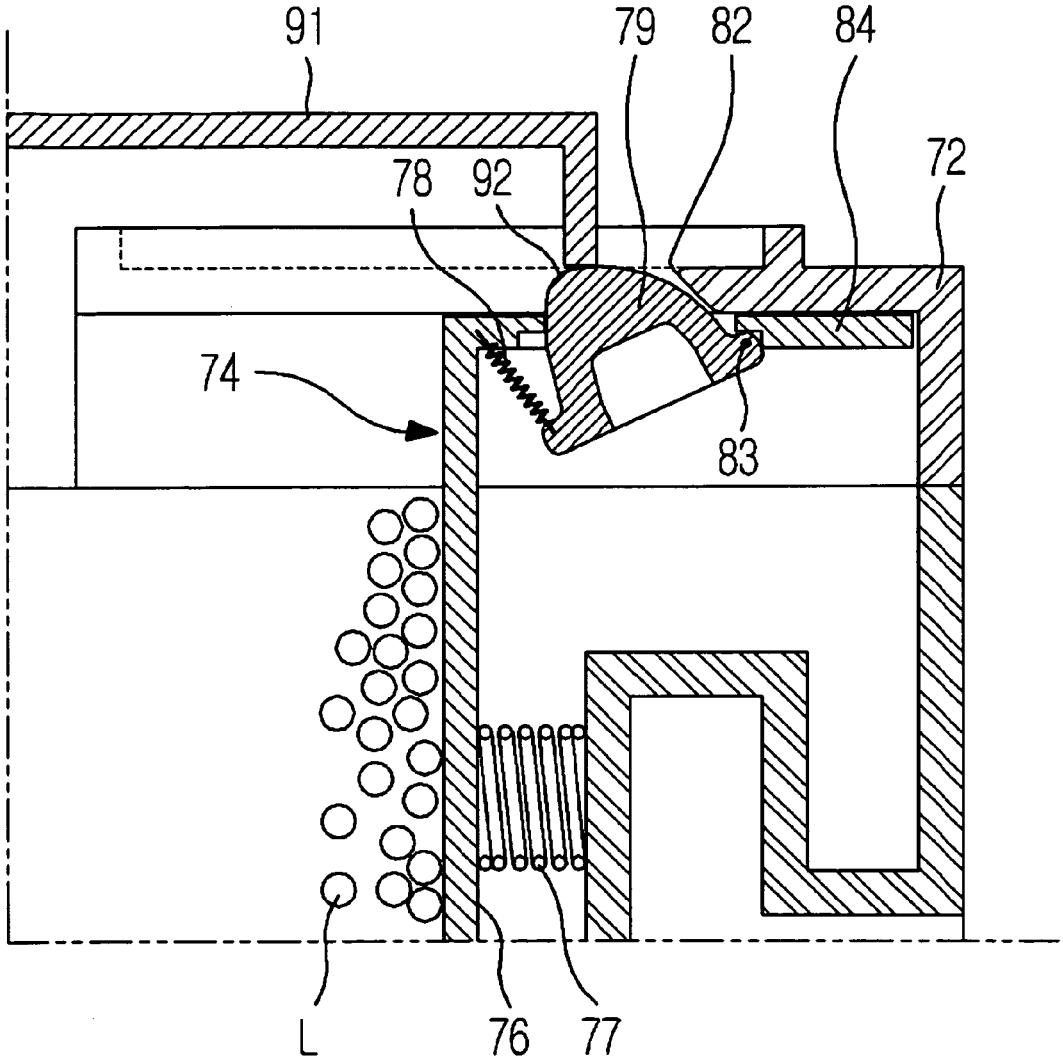
Figure 8D:
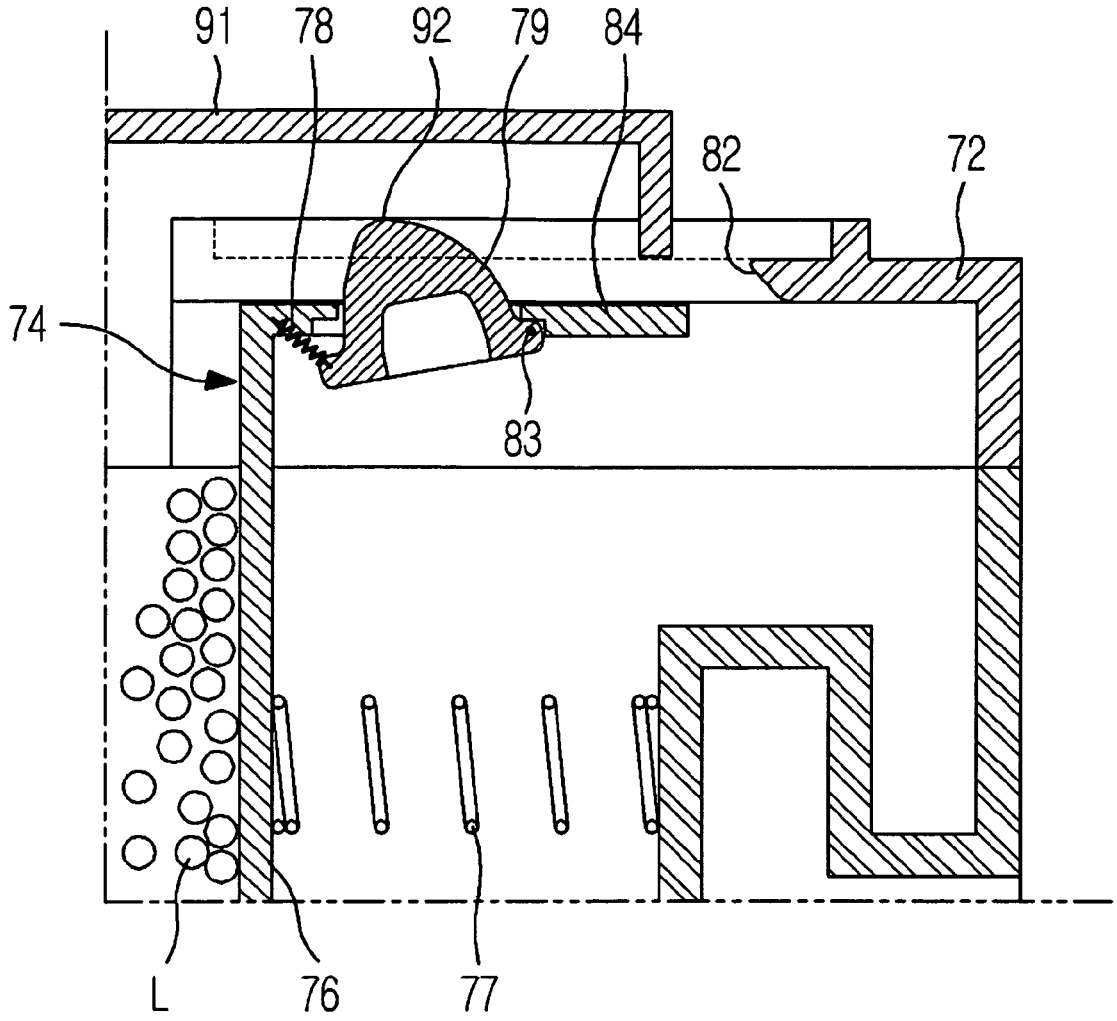

In FIGS. 7A and 8A, inlets 95 and 96 of a tank 72 are closed by a push plate 74. In FIGS. 7B and 8B, the inlets 95 and 96 of the tank 72 are partially opened as the push plate 74 moves. In FIGS. 7C and 8C, the inlets 95 and 96 of the tank 72 are fully opened as the push plate 74 further moves to the right. In FIGS. 7D and 8D, the push plate 74 returns to its original position by elastic force from a first elastic member 77 so that the inlets 95 and 96 of the tank 72 are closed.

The storage unit 71 includes the tank 72 and the push plate 74. The storage unit 71 may be detachably coupled to the collection unit 41. The tank 72 includes a tank cover 80 hingedly rotatably mounted to the tank 72 to cover the open top thereof.

The tank 72 is provided at the side and the top 85 thereof with the inlets 95 and 96 through which lint is received. The storage unit 71 is connected to the collection unit 41 so that the inlets 95 and 96 correspond to the discharge port 64 of the collection unit 41.

The push plate 74 is disposed in the tank 72 so that the push plate 74 moves inward and outward. The push plate 74 includes first and second opening and closing surfaces 84 and 85 to open and close the inlets 95 and 96 and a compression surface 76 to compress the received lint. A button 79 is hingedly coupled to the first opening and closing surface so that the button 79 is hingedly rotated upward and downward.

The button 79 includes a protruding round surface 92.

The tank 72 is provided at the top 85 thereof with a button guide 81, by which the button 79 is rotated upward so that the button 79 protrude above the first opening and closing surface 84 of the push plate 74 and the top 85 of the tank 72.

Also, the push plate 74 includes a first elastic member 77 and a second elastic member 78. The first elastic member 77 is mounted between the compression surface 76 of the push plate 64 and the inside of the tank 72 to elastically bias the first and second opening and closing surfaces 84 and 85 of the push plate 74 so that the first and second opening and closing surfaces 84 and 85 of the push plate 74 close the inlets 95 and 96.

The second elastic member 78 is mounted between the push plate 74 and the button 79 to elastically bias the button 79 so that the button 79 protrudes above the first opening and closing surface 84 of the push plate 74 and the top 85 of the tank 72.

Meanwhile, the storage unit 71 includes a push rod 91 to push the button 79 in the direction in which the first and second opening and closing surfaces 84 and 85 of the push plate 74 open the inlets 95 and 96. The push rod 91 is connected to the drive motor 31 via a gear cam 33 so that power from the drive motor 31 is transmitted to the push rod 91.

At the end of the button guide 81 of the tank cover 80 is provided a switch 82 to push the button 79 so that the button 79 is hidden below the first opening and closing surface 84 of the push plate 74 when the round surface 92 of the button 79 comes into tight contact with the switch 82.

In particular, the switch 82 is provided at a position where the button 79 is pushed so as to be hidden below when the push plate 74 approximately fully opens the inlets 95 and 96.

When the push rod 91 continues to push the button 79, force from the push rod 91 and the switch 82 is simultaneously applied to the button 79 with the result that the button 79 rotates about a hinge shaft 83 counterclockwise. At a predetermined point of time, as shown in FIG. 8D, the button 79 is fully hidden below the push rod 91 with the result that force from the push rod is not applied to the button 79. In this state, external force is removed from the push plate 74. Consequently, the push plate 74 moves in the direction in which the push plate 74 closes the inlets 95 and 96 by elastic force from the first elastic member 77. At this time, the lint L stored in the tank 72 is compressed by the compression surface 76 of the push plate 74. In this way, the lint is stored in a compressed state. Consequently, a large amount of lint may be stored in the tank 72, and therefore, the storage unit 71 may be used for a long time without replacement.

When a user wishes to discharge the lint from the storage unit 71, the user may separate the storage unit 71 from the collection unit 41 and open the tank cover 80 to dump the lint. During separation, the storage unit 71 does not apply force to the button 74 of the push rod 91. Consequently, the push plate 74 closes the inlets 95 and 96 of the tank 72 by elastic force from the first elastic member 77, preventing the lint from being discharged to the outside through the inlet 95 and 96, and the user may open the tank cover 80 so as to conveniently discharge the lint.

Figure 9A:
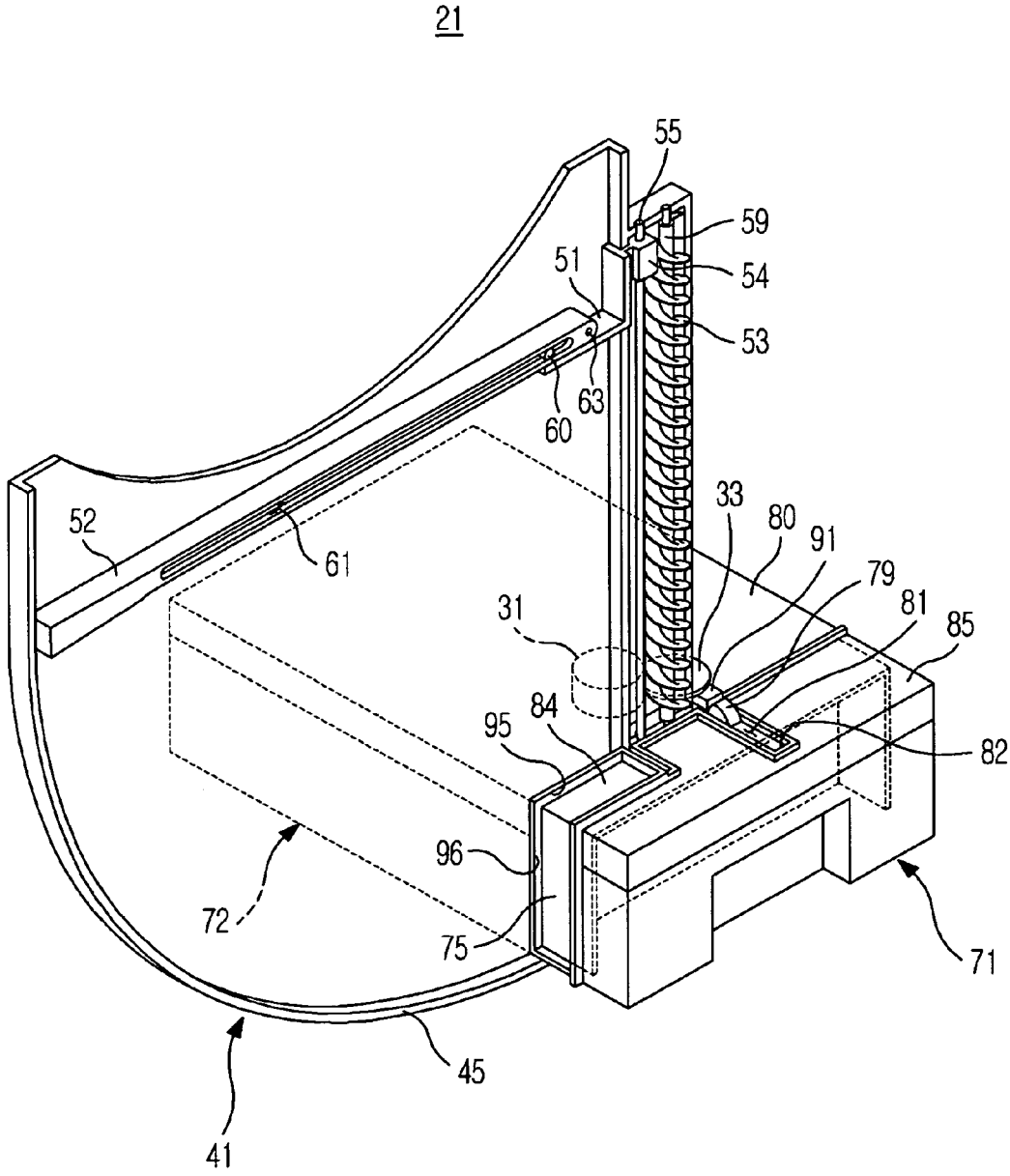
FIGS. 9A and 9B are views illustrating interlocking of the collection unit and the storage unit of the clothes dryer according to the embodiment of the present disclosure.
Figure 9B:
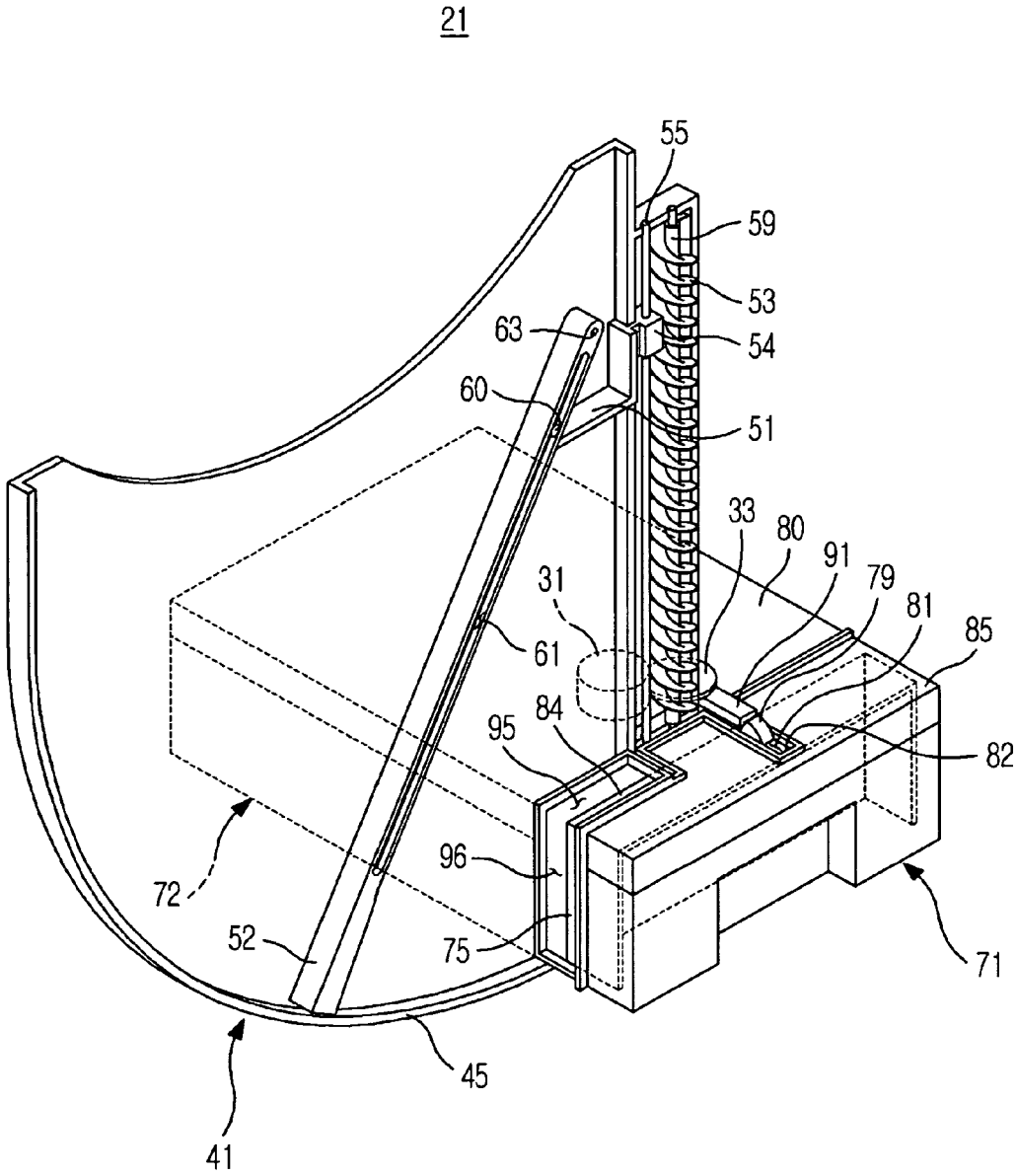

FIGS. 9A and 9B are views illustrating interlocking of the collection unit and the storage unit of the clothes dryer according to the embodiment of the present disclosure.

In the clothes dryer according to the embodiment, the collection unit 41 and the storage unit 71 interlocks with each other so as to be operated by drive force from at least one drive motor 31. Specifically, the rectilinear blade 51 and the rotary blade 52 of the collection unit 41 interlock with the push rod 91 of the storage unit 71. Although one drive motor 31 is provided and the structure of the gear cam 33 to transmit drive force from the drive motor 31 to the collection unit 41 and the storage unit 71 is simply shown in the drawings, an additional drive motor may be provided and the structure of the gear cam may be further complicated.

The interlocking of the collection unit 41 and the storage unit 71 is achieved so that, as shown in FIG. 9A, the inlets 95 and 96 of the tank 72 remain closed when the rectilinear blade 51 and the rotary blade 52 of the collection unit 41 start to perform cleaning at initial positions thereof and, as shown in FIG. 9B, the inlets 95 and 96 of the tank 72 are opened as the rectilinear blade 51 and the rotary blade 52 continue to perform the cleaning. When the rectilinear blade 51 and the rotary blade 52 collect lint at the discharge port 64 (see FIG. 5A to 5C) formed at the right lower end of the collection unit 41 as the cleaning is further performed, the inlets 95 and 96 of the tank 72 connected to the discharge port 64 are fully opened.

The above operations may be achieved by interlocking of the rectilinear blade 51 and the rotary blade 52 of the collection unit 41 and the push rod 91 of the storage unit 71.

Figure 10:
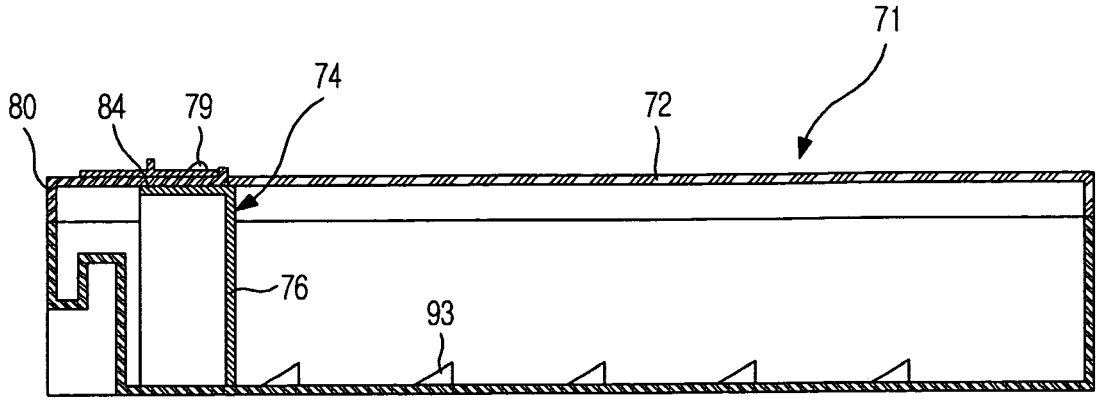
FIG. 10 is a side sectional view illustrating storage unit of the clothes dryer according to the embodiment of the present disclosure.

FIG. 10 is a side sectional view illustrating storage unit of the clothes dryer according to the embodiment of the present disclosure.

Hooked ribs 93 are formed in the tank 72 at predetermined intervals to prevent swelling of the lint compressed as described above. The hooked ribs 93 allow the lint L to move in the compressed direction and prevent the lint L from moving in the opposite direction, thereby preventing the lint L from moving backward to the collection unit through the inlets 95 and 96 when the push plate 74 is opened.

Hereinafter, the operation of the cleaning device 21 of the clothes dryer according to the embodiment of the present disclosure will be described briefly.

Lint L, generated during drying of clothes in the drum 11, is introduced into the collection unit 41 through the introduction port 44 together with humid air. When the humid air passes through the filter 42 of the collection unit 41, the lint L is attached to the filter 42. The air, from which the lint L has been removed, flows to the exhaust duct 17.

When the drive motor 31 of the cleaning device 21 is operated by user manipulation, the spiral 53 of the collection unit 41 rotates about the rotary shaft 59 with the result that the insertion end 57 of the rectilinear blade 51, positioned in the valley of the spiral 53, moves downward along the valley of the spiral 53. Consequently, the rectilinear blade 51 moves downward to collect the lint L attached to the filter 42 downward. At this time, the catching protrusion 60, positioned in the catching groove 61 of the rotary blade 52, also moves downward with the result that the rotary blade 52 rotates about the hinge shaft 63 counterclockwise. During rotation, the rotary blade 52 collects the lint L attached to the filter 42 to the right lower part.

In connection with the collection performed by the collection unit 41, storage and compression are performed by the storage unit 71.

When the drive motor 31 starts to be operated, power from the drive motor 31 or another drive motor (not shown) is transmitted to the push rod 91, which then moves to push the button 79 coupled to the push plate 74. At the initial stage, the inlets 95 and 96 of the tank 72 remains closed by the push plate 74. As the push rod 91 pushes the button 79 coupled to the push plate 74 as described above, the inlets 95 and 96 are gradually opened. While the rectilinear blade 51 and the rotary blade 52 of the collection unit 41 collect the lint L at the discharge port 64 of the collection unit 41, the push rod 91 continuously push the button 79. When all the lint L is collected at the discharge port 64 of the collection unit 41, the inlets 95 and 96 are fully opened so that the lint L is received into the tank 72 through the discharge port 64 of the collection unit 41 and the inlets 95 and 96 of the tank 72.

Subsequently, when the push rod 91 continues to push the button 79, the button 79 comes into tight contact with the switch 82. At this time, the button 79 is pushed by the switch 82 as the result of reaction. Consequently, the button 79 is hidden below the first opening and closing surface 84 of the push plate 74. As a result, force from the push rod 91 is not applied to the push plate 74 any more, and therefore, the push plate 74 is instantaneously moved to its original position by elastic force from the first elastic member 77. At this time, the lint L stored in the tank 72 is compressed.

As is apparent from the above description, the clothes dryer includes a cleaning device to collect lint through a simple and inexpensive structure. Also, the collect lint is stored in a compressed state, and therefore, the cleaning device may be used for a long time without replacement.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A clothes dryer comprising:

a case forming an external appearance thereof;

a drum rotatably mounted in the case;

an intake duct to guide external air so that the air is supplied to the drum;

an exhaust duct to guide air in the drum so that the air is discharged to an outside;

a blower mounted in the exhaust duct; and a collection unit mounted between the drum and the blower, the collection unit comprising a filter to filter lint, a rectilinear blade configured to be rectilinearly moved by a drive source to collect the lint, and a rotary blade configured to perform a rotary motion interlocking with the rectilinear motion to collect the lint.

2. The clothes dryer according to claim 1, further comprising a storage unit comprising a tank to store the lint collected by the rectilinear blade and the rotary blade and a push plate mounted in the tank so that the push plate moves inward and outward to open and close an inlet of the tank and, at the same time, to compress the lint.

3. The clothes dryer according to claim 2, wherein the collection unit has a discharge port formed at a space where the lint is collected by the rectilinear blade and the rotary blade, and the discharge port of the collection unit communicates with the inlet of the tank of the storage unit.

4. The clothes dryer according to claim 3, wherein the push plate of the storage unit opens the inlet of the tank of the storage unit when the rectilinear blade and the rotary blade of the collection unit collect the lint and discharge the collected lint through the discharge port of the collection unit.

5. The clothes dryer according to claim 2, further comprising at least one drive motor to drive the collection unit and the storage unit.

6. The clothes dryer according to claim 1, wherein the collection unit further comprises an introduction port communicating with the drum, and the introduction port comprises a screen to prevent articles to be dried from being introduced into the collection unit.

7. The clothes dryer according to claim 1, wherein the collection unit further comprises a guide bar to guide the motion of the rectilinear blade.

8. The clothes dryer according to claim 1, wherein the drive source comprises a motor and a spiral configured to be rotated by drive force from the motor.

9. The clothes dryer according to claim 8, wherein the rectilinear blade comprises an insertion end positioned in a valley of the spiral, and the insertion end performs a rectilinear motion interlocking with the rotary motion of the spiral so that the rectilinear blade performs the rectilinear motion.

10. The clothes dryer according to claim 1, wherein the rectilinear blade comprises a catching protrusion, and the rotary blade comprises a catching groove, in which the catching protrusion is positioned so as to move inward and outward, formed in a longitudinal direction thereof.

11. The clothes dryer according to claim 10, wherein the rotary blade is hingedly coupled in the collection unit so that the catching protrusion moves inward into and outward from the catching groove to rotate the rotary blade.

12. The clothes dryer according to claim 2, wherein the push plate comprises an upper end surface to which a button having a round surface is hingedly coupled so that the button is rotated upward and downward, an opening and closing surface to open and close the inlet, and a compression surface to compress lint.

13. The clothes dryer according to claim 12, wherein the push plate comprises a first elastic member and a second elastic member, the first elastic member elastically biases the opening and closing surface and the compression surface so that the opening and closing surface closes the inlet and, at the same time, the compression surface compresses lint, and the second elastic member elastically biases the button so that the round surface of the button protrudes above the upper end surface of the push plate.

14. The clothes dryer according to claim 12, wherein the storage unit further comprises a push rod to push the button in a direction in which the opening and closing surface opens the inlet.

15. The clothes dryer according to claim 12, wherein the storage unit further comprises a switch to push the button so that the button is hidden below the upper end surface of the push plate.

16. The clothes dryer according to claim 2, wherein the storage unit is detachably coupled to the collection unit.

17. The clothes dryer according to claim 2, wherein the tank comprises hooked ribs formed therein at predetermined intervals to prevent swelling of the compressed lint.

18. A clothes dryer comprising a case forming an external appearance thereof, a drum rotatably mounted in the case, an intake duct to guide external air so that the air is supplied to the drum, an exhaust duct to guide air in the drum so that the air is discharged to an outside, a blower mounted in the exhaust duct, and a cleaning device mounted between the drum and the blower to clean lint, wherein the cleaning device comprises a collection unit to filter and collect lint and a storage unit to compress and store the lint, the collection unit comprises a filter to filter lint, a rectilinear blade configured to be rectilinearly moved by a drive source to collect the lint, and a rotary blade configured to perform a rotary motion interlocking with the rectilinear motion to collect the lint, and the storage unit comprises a tank to store the lint and a push plate mounted in the tank so that the push plate moves inward and outward to open and close an inlet of the tank and, at the same time, to compress the lint.

19. A lint cleaning device mounted between a drum and a blower of a clothes dryer, comprising:

a filter to filter lint;

a rectilinear blade configured to be rectilinearly moved by a drive source to collect the lint; and a rotary blade configured to perform a rotary motion interlocking with the rectilinear motion to collect the lint.

20. A lint cleaning device mounted between a drum and a blower of a clothes dryer, comprising:

a collection unit to filter and collect lint and a storage unit to compress and store the lint, wherein the collection unit comprises a filter to filter lint, a rectilinear blade configured to be rectilinearly moved by a drive source to collect the lint, and a rotary blade configured to perform a rotary motion interlocking with the rectilinear motion to collect the lint, and the storage unit comprises a tank to store the lint and a push plate mounted in the tank so that the push plate moves inward and outward to open and close an inlet of the tank and, at the same time, to compress the lint.

* * * * *